United States Patent [19]

Haas et al.

[11] Patent Number: 4,605,246

[45] Date of Patent: Aug. 12, 1986

[54] WRITING BOARD

[75] Inventors: David J. Haas, Suffern, N.Y.; Alexander J. Autote, Stamford, Conn.

[73] Assignee: Temtec Inc., Suffern, N.Y.

[21] Appl. No.: 683,032

[22] Filed: Dec. 18, 1984

Related U.S. Application Data

[63] Continuation-in-part of Ser. No. 564,172, Dec. 22, 1983.

[51] Int. Cl.[4] ..... B42F 9/00; B42D 1/00

[52] U.S. Cl. ..... 282/29 A; 248/444; 281/1; 281/45; 282/1 R

[58] Field of Search ..... 282/1 R, 29 R, 29 A, 282/29 B, 29 C; 283/81, 74, 45; 428/40, 42; 24/67.7, 301; 156/277; 248/444; 269/117; 281/6, 92, 45, 1

[56] References Cited

U.S. PATENT DOCUMENTS

| | | | |
|---|---|---|---|
| 2,060,355 | 11/1936 | Twomley | 248/444 |
| 4,148,506 | 4/1979 | Lamb | 281/45 |
| 4,243,249 | 1/1981 | Goss | 281/1 R |
| 4,394,038 | 7/1983 | Klein | 281/1 R |

FOREIGN PATENT DOCUMENTS

| | | | |
|---|---|---|---|
| 356365 | 10/1931 | United Kingdom | 282/DIG. 2 |

*Primary Examiner*—Paul A. Bell

*Attorney, Agent, or Firm*—Ostrolenk, Faber, Gerb & Soffen

[57] ABSTRACT

A writing board is provided for mounting an overlying sheet for writing information thereon and an underlying sheet for storing a copy of the information. The board comprises a board having a writing surface thereon wherein portions of the surface are non-adhesive and tacky. A mounting means is attached to the board for removably mounting to the board the overlying sheet along an edge of the sheet. Portions of the non-adhesive tacky surface grip the underlying sheet to the surface to prevent slippage of the underlying sheet while writing thereon. Preferably, an other mounting means is attached to the board for additionally removably mounting the underlying sheet to the board along the edge of the sheet. The preferred mounting means it comprises a plurality of clips, wherein a means is provided for releasing the clip upon forcing the board down on a hard surface. Preferably the underlying sheet is a plurality of temporary identification badges and the overlying sheet a log therefore. The board, however, may also be used for inventory control stickers, convention name tags, property pass stickers, etc.

13 Claims, 4 Drawing Figures

WRITING BOARD

RELATED APPLICATION

This application is a continuation-in-part of a an application of U.S. Ser. No. 564,172 filed on Dec. 22, 1983, the entire disclosure of which is incorporated herein by reference.

BACKGROUND OF THE INVENTION

1. Field of the Invention

This invention relates to writing boards, and in particular, writing boards which may be used with visitor control badges wherein the signature or name of the person being issued the badge is required to be written thereon to uniquely link the badge to the user.

2. Description of the Prior Art

Identification badges have come into general use because of the need to discriminate between authorized and unauthorized persons and between employees and non-employees, as well as other groups of persons. Improved security of a facility or a business is achieved when an effective identification badge system is employed. A key to a high security performance badge system is that each badge is assigned to one individual, and that the individual is uniquely linked to the badge itself by some physiological factor such as a photograph, fingerprint, hand geometry, voice print, and in particular by name and signature. If a physiological link is unavailable for use, the badge can be employed improperly, e.g. transference of the card from an authorized person to an unauthorized person or admittance of an unauthorized person into an excluded area. Where a physiological link is employed such as a signature, the issuance of such a badge can be relatively time consuming and burdensome to the persons issuing such badge. The determination of whether such badges are valid or expired has been solved, to a large extent, by Assignees invention described and claimed in U.S. Pat. No. 4,432,630 issued on Feb. 21, 1984. The system described therein has as a key element thereof a badge which has at least one surface coated with an ambient lightsensitive coating which when exposed to ambient light conditions for a specified predetermined period of time changes color. An attachment means is also provided for attaching the badge to a wearer and permitting exposure of the badge to ambient light. Typically the attachment means comprises an adhesive applied to the rear of the badge which is exposed for use by peeling off a protective waxlike sheet. In use the badge is attached to the wearer and when exposed to ambient light for the specified predetermined period of time, e.g. 8 hours, the badge changes color. This is a clear indication of the expiration of the badge.

The present invention resolves a problem associated with these badges. In particular, the signature or name of the person using the badge is placed on the badge as the physiological link between the user and the badge. In order to keep a record of the visitors it is also desirable to provide a logsheet which can be filled in with more relevant information than just the visitors name i.e. address, company name, purpose of visit, time in, time out, etc. In order to avoid having the visitor or the secretary fill out two forms, a system was devised by assignee which comprises an overlying logsheet upon which is written all the useful information that is required and an underlying badge which simultaneously record only the user name and/or signature and, perhaps, other information written on the log. It was found that the temporary badges, due to a glossy or waxlike protective sheet applied over the adhesive which is used as the attachment means tended to slip and slide when place on, for example, a writing board such as a clipboard.

Additionally, the badges typically came in long longitudinal strips having a plurality of badges which could be torn off and assigned to the person, although these may be provided in a single sheet. These were difficult to maintain on a clipboard and were cumbersome to use, in that, typically the overlying sheet had to be removed from the underlying sheet, the badge removed and then the overlying sheet placed thereon again.

Another problem associated with the use of such a cumbersome badge system is that a secretary or receptionist, often times the only one being present, will be burdened by filling out these forms, and if there is a number of visitors coming in at one time, they must wait on line until she fills out the form for each person. With a simpler system the visitor himself can fill out the log and badge.

Additionally, it is often desirable that a disclaimer be shown the visitor at the time he is assigned the badge. The sign-in/log sheets often used do not guaranty that such visitor will see such disclaimer, particularly if the secretary or receptionist has to fill out the form due to its cumbersome manner of construction.

Applicant herein has solved all of the above problems associated with temporary badge security systems and, in effect, has developed a writing board which not only has applicability to temporary badge identification systems, but has broader applications as well, e.g.: inventory control stickers, convention name tags, property pass stickers, etc.

Numerous writing boards and forms are known in the art which enable a person to make copies and/or write thereon, for example, see the following U.S. Patents:

1,111,004 to Butler;
2,060,355 to Twomly;
2,876,022 to Kroviak;
3,107,927 to Terrell;
4,021,060 to Seeley et al.;
4,159,129 to Lockhart;
4,191,405 to Johnstun; and
4,204,706 to Blum et al.

None of these references teach or suggest a writing board similar to that described herein which solves all the aforementioned problems when used in conjunction with a temporary badge system nor has all the elements of applicant's claimed invention.

OBJECTS AND SUMMARY OF THE INVENTION

It is an object of this invention to provide a writing board which is suitable for use in conjunction with a temporary badge security system.

It is a further object of this invention to provide a writing board which frictionally grips the underlying sheet to prevent slippage of the sheet while writing thereon.

It is a further object of this invention to provide a writing board which not only grips the underlying sheet but, when used in conjunction with a plurality of longitudinal spaced apart strips, each comprising a temporary badge, grips the overlying sheet as well as the underlying sheet.

It is still a further object of this invention to provide a writing board which may be easily used by a visitor to not only fill in the visitors badge which is used, but also provide additional information in a simple and non-cumbersome manner.

It is a further object of this invention that guarantees that when a person receives a visitors badge he has already supplied to the user all the relevant information to identify himself.

It is a further object of this invention to provide a writing board which may have thereon a disclaimer associated therewith, or other type information, which guarantees that the visitor has seen such information prior to issuance of the badge, because the visitor has used the specifice writing board to complete the badge and log.

It is a further object of this invention to provide a writing board that has applications other than for use with a temporary badge security system.

All of the objects as well as others are achieved by the writing board of this invention. Broadly, the writing board is used for mounting an overlying sheet for writing information thereon and an underlying sheet for storing a copy of the information. The board comprises a board having a writing surface thereon wherein portions of the surface are non-adhesive and tacky. A mounting means is attached to the board for removably mounting to the board the overlying sheet along an edge of the sheet. Portions of the non-adhesive tacky surface grip the underlying sheet to the surface to prevent slippage of the underlying sheet while writing thereon. Preferably, another mounting means is attached to the board for removably mounting the underlying sheet to the board along the edge of the sheet. The preferred mounting means comprises a plurality of clips, wherein a means is provided for releasing the clip upon forcing the board down on a hard surface. Preferably, the underlying sheet is a plurality of temporary identification badges and the overlying sheet a log sheet therefore.

DETAILED DESCRIPTION OF THE INVENTION

Figure 1:
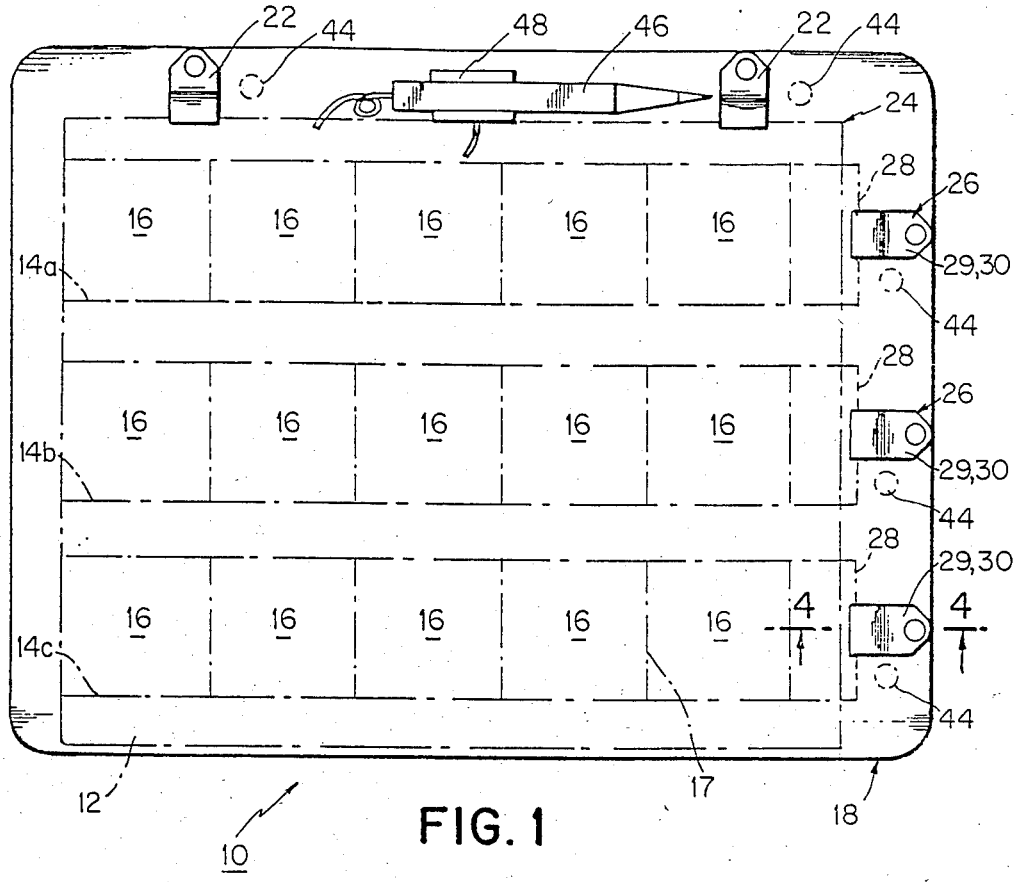
FIG. 1 is a top view of the writing board of this invention.
Figure 2:
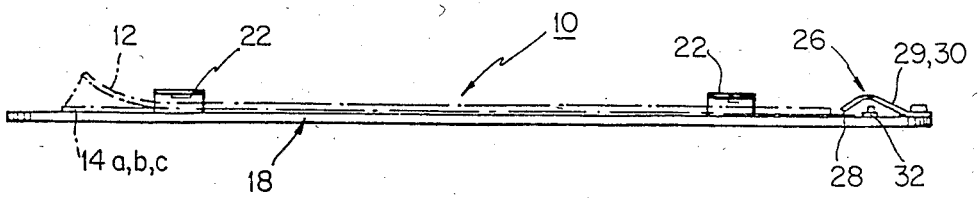
FIG. 2 is a side view of the writing board of this invention.
Figure 3:
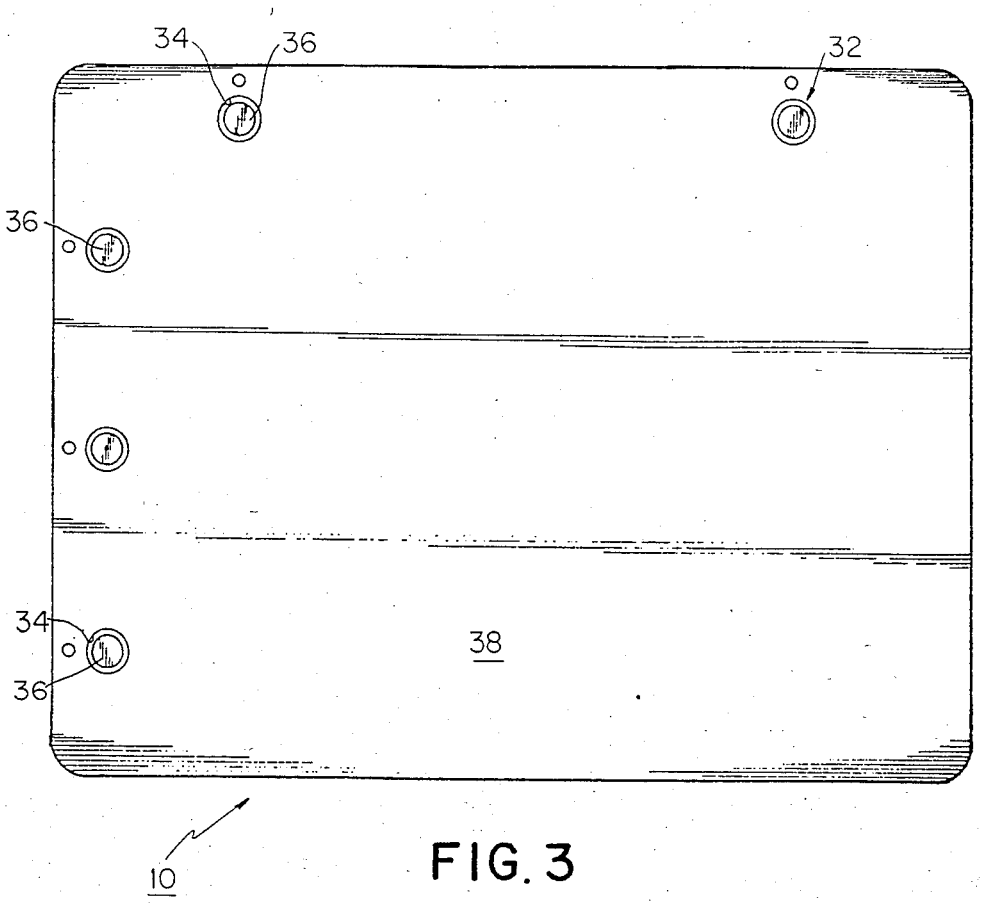
FIG. 3 is a bottom view of the writing board of this invention.
Figure 4:
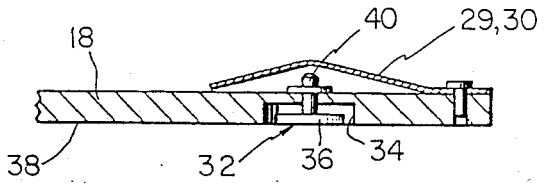
FIG. 4 is a cross-sectional view taken along the line 44 of FIG. 1.

Referring to FIGS. 1 through 4, a writing board, generally designated 10 is provided. The board is a lightweight writing platen and much like the shape of the wellknown clipboard and may be manufactured from the same type material, i.e. bristleboard, wood, plastic, etc. Board 10 is designed for mounting an overlying sheet 12. Such an overlying sheet 12 may be a "log" type sheet and is provided for writing information thereon, for example, a visitor's name, address, who he is representing, the date of his entrance into the plant, the purpose of his visit, whether he is a U.S. citizen, his time in and time out. An underlying sheet 14 is provided for storing a copy of either all or a portion of the information which is written on the overlying sheet 12. In preferred temporary badge security system used by applicant, the underlying sheet 14 is comprised as a plurality of spaced apart longitudinal sheets, 14*a*, 14*b*, 14*c*, preferably 3. Each longitudinal sheet 14*a, b, c* comprises a plurality of temporary security badges 16, e.g. five such badges are depicted in FIG. 1, each being capable of being removed by tearing along performation 17. In the highly preferred system, the temporary security badge as described in U.S. Pat. No. 4,432,630 to Haas is used and comprises a badge which has at least one surface coated with an ambient light-sensitive coating which when exposed to ambient light conditions for specified predetermined period of time changes color. A further coating or layer may be applied over the light-sensitive material to filter a portion of the incident ambient light so as to adjust the rate of change to meet the requirements of the user. The other side of the badge has thereon an adhesive the adhesive being used for attaching the badge 16 to a wearer and permitting exposure of the badge to ambient light. Typically, the adhesive is covered by a glossy and/or slippery waxlike release paper which exposes the pressure sensitive adhesive thereon, enabling application of the badge to the wearer.

In use, the writing board 10 is provided with a plurality of individual preprinted self-destructing or temporary badges 16 in the form of three longitudinal spaced-apart sheets, 14*a, b, c*. The overlying sheet 12 is a log sheet which is secured and placed over the badges 16 on the platen or board 10. Typically each log sheet 12 contains a plurality of sign-in boxes which cover the badges 16. The log sheet 12 is carbonbacked in the areas where the visitor is asked to print his name and date. When the visitor completes the log sheet 12, he or she has automatically made up their own badge. All that remains is for the receptionist to tear the badge 16 off and to peel the badge off the backing paper and issue it to the visitor. The log sheets 12 may be perforated in squares so that the user has the option of either tearing the log sheet 12 apart and retaining the visitor data in a card file format or leaving the sheet whole.

The board 10 has a writing surface 18. Portions of the surface 18 are non-adhesive and tacky. In the preferred embodiment the board is completely covered with such a nonadhesive and tacky layer. Preferred materials for coating are, for example, the silicone type adhesive sealants. One preferred type is General Electric RTV 118. Another preferred silicone type adhesive is Dow Corning material Silastic 734 RTV selfleveling adhesive/sealant. This is a one-component silicone rubber. Other type compounds may be used to coat the writing board and provide it with such a non-adhesive and tacky surface.

By the use of the term "non-adhesive and tacky" it is meant that a paper when applied to the surface is gripped by the surface but can be easily peeled therefrom. Such compounds as GE RTV 118 and Dow silastic 734, which are silicone rubbers, provide such a surface after curing.

The compounds may be dipped, brushed or sprayed onto the surface and cured by merely contacting the coating with moisture in the air. The coating forms a tough, silicone rubber non-adhesive surface.

The writing board 10 is further provided with a mounting means, generally designated 22, attached to the board 10 for removably mounting to the board 10 the overlying sheet 12 along an edge of the sheet 24. It is preferred that this mounting means 22 be provided on the top of the board 10.

Preferably, the writing board 10 further comprises another mounting means 26 attached to the board for removably mounting the underlying sheet 14 to the board along the edge 28 of the underlying sheet 14. Preferably, this mounting means 26 is on the right-hand side of the writing board 10, as indicated in FIG. 1, while in use, for easy removal of the underlying sheet 14 by the user, most people being right-handed.

In the preferred embodiment, the underlying sheet 14, as indicated previously, is a plurality of spaced apart longitudinal sheets 14*a, b, c,* each sheet comprising a plurality of badges 16. With such an embodiment it is desirable, for ease of use and mounting of badges 16 thereto that the mounting means, at least for the underlying sheets 14, comprise a plurality of clips 29, each clip removably mounting a longitudinal sheet 14 to the board 10. Such clips may also be used to mount the overlying sheet 12.

In the preferred embodiment each clip 29 comprises a substantially flat spring 30 secured to the board 10 for engaging and holding the sheet 14 lying on the board. A means is also provided for lifting the spring to remove the sheet 14. The preferred means for lifting the spring 30 comprises a button 32 which passes through a bore 34 in the board 10. The button 32 has its lower end 36 projecting from the lower surface 38 of the board 10. The upper end 40 of the button 32 contacts the spring 30. The button 32 is slidable within the bore 34. The upper end 40 has a retaining shoulder 42 which abuts the top surface of the board 10. Thus, when the board 10 is forced downward, the button 32 slides upward to raise the spring 30 and release the sheet 14 and when the force is removed the spring 30 engages and holds the sheet 14. Preferably, an area 44 is marked on the board 10 to indicate where to press downward. This type mounting means is described in U.S. Pat. No. 2,060,355 to Twomley, however, Twomley utilizes a counter sunk opening at the bottom of the board and requires the use of pressing the finger into this counter-sunk hole to raise the button to thereby lift the spring clip. Applicant's devise provides for the ready insertion and removal of the underlying 14 or overlying sheet 12 by merely pressing down on the board 10 at an indicated spot 44 on the board 10 and thus does not require the person to slip his finger under the board or turn the board upside down to remove the paper. The paper may thus be easily removed without requiring the cumbersome process shown in Twomley.

At least a portion of the under surface of the overlying sheet 12 may be "spot carbonized" or "inked", so that when marking pressure is applied to the outer surface of the overlying sheet 12 when it lies flat against the underlying sheet 14, a corresponding ink mark is produced on the underlying sheet 14. Instead of spot carbonizing the undersurface of the overlying sheet 12, both the underlying 14 and overlying 12 sheet can be formed of pressure-sensitive papers which cooperate to produce dark marks on the underlying sheet 14 in response to marking pressure transmitted to the overlying sheet 12. These type of pressure-sensitive papers are commonly referred to as "NCR paper" or carbonless forms. In the preferred embodiment after the overlying or log sheet 12 is written upon and the information transferred to the underlying light-sensitive identification badges 16 the badge 16 is removed along a perforated line 17, and the protective sheet peeled away from the adhesive under side of the badge 16. The badge 16 is then mounted to the user.

Preferably the board 10 is equipped with a captive coilcord ball point pen 46 and a holder 48 therefor.

The portions of the non-adhesive and tacky surface grip the underlying sheet 14 to prevent slippage of the sheet while writing thereon. When the board 10 is utilized in conjunction with a plurality of spaced apart longitudinal sheets 14*a, b, c,* the non-adhesive and tacky surface of the board grips the overlying sheet 12 as well as the underlying sheet 14 to also prevent slippage of the overlying sheet 12 while writing thereon.

It will be obvious to those skilled in the art that various modifications may be made in the device which are within the scope of the invention. Therefore, it is intended that the present invention be limited only by the scope of the claims attended hereto.

What is claimed is:

1. A writing board for mounting an overlying sheet for writing information thereon and an underlying sheet for storing a copy of the information, the board comprising a board;

a mounting means attached to the board for removably mounting to the board the overlying sheet along an edge of the sheet;

an other mounting means attached to the board for removably mounting the underlying sheet to the board along an edge of the sheet;

wherein the mounting means for the underlying sheet and overlying sheet comprise a plurality of clips, each clip comprising a substantially flat spring secured to the board for engaging and holding the sheet lying on the board and a means for lifting the spring to remove the sheet, the means for lifting comprising a button passing through a bore in the board, its lower end projecting from the lower surface of the board and its upper end in contact with the spring, the button slideable within the bore, whereby when the bore is force downward the button slides upward to raise the spring and release the sheet and when the force is removed from the board the spring engages and holds the sheet.

2. The writing board of claim 1, wherein the board has a writing surface wherein portions thereof are non-adhesive and tacky and grip the underlying sheet thereto to prevent slippage of the underlying sheet while writing thereon.

3. The writing board of claim 1, wherein longitudinal sheets comprise a plurality of security badges and the overlying sheet is a log sheet.

4. A writing board for mounting an overlying sheet for writing information thereon, the board comprising:

a board having a writing surface thereon; a mounting means attached to the board for removing mounting to the board the overlying sheet along an edge of the sheet;

wherein the mounting means for the overlying sheet comprises at least one clip, the clip comprising a substantially flat spring secured to the board for engaging and holding the sheet lying on the board and means for lifting the spring to remove the sheet;

wherein the means for lifting the spring comprises a button passing through a bore in the board, its lower end projecting from the lower surface of the board and its upper end in contact with the spring, the button slidable within the bore;

whereby when the board is forced downward, the button slides upward to raise the spring and release the sheet and when the force is removed from the board the spring engages and holds the sheet.

5. A writing board for mounting an overlying sheet for writing information thereon and an underlying sheet for storing a copy of the information, the board comprising:

a board having a writing surface wherein portions thereof are non-adhesive and tacky;

a mounting means attached to the board for removably mounting to the board the overlying sheet along an edge of the sheet;

wherein the underlying sheet is plurality of spaced apart longitudinal sheets;

wherein portions of the non-adhesive tacky surface grip the underlying sheet thereto to prevent slippage of the underlying sheet while writing thereon and wherein the portions of the nonadhesive and tacky surface grip the overlying sheet thereto to also prevent slippage of the overlying sheet while writing thereon;

wherein the mounting means for the underlying sheet comprises a plurality of clips, each clip removably mounting a longitudinal sheet to the board;

wherein each clip comprises a substantially flat spring secured to the board for engaging and holding a sheet lying on the board and a means for lifting the spring to remove the sheet; and wherein the means for lifting the spring comprises a button passing through a bore in the board, its lower end projecting from the lower surface of the board and its upper end in contact with the spring, the button slidable within the bore, whereby when the board is forced downward, the button slides upward to raise the spring and release the sheet, and when the force is removed from the board the spring engages and holds the sheet.

6. A temporary badge security system comprising:

a writing board having a writing surface wherein portions thereof are non-adhesive and tacky;

an overlying log sheet for writing information thereon;

a mounting means attached to the board for removably mounting to the board the overlying log sheet along an edge of the sheet;

an underlying sheet comprising a plurality of temporary security badges, each badge adapted for storing a copy of at least a portion of the information which is written on the overlying log sheet and;

wherein portions of the non-adhesive tacky surface grip the underlying sheet thereto to prevent slippage of the underlying sheet while writing thereon.

7. A temporary badge security system comprising:

a writing board having a writing surface wherein portions thereof are non-adhesive and tacky;

an overlying log sheet for writing information thereon;

a mounting means attached to the board for removably mounting to the board the overlying log sheet along an edge of the sheet;

an underlying sheet comprising a plurality of temporary security badges, each badge adapted for storing a copy of at least a portion of the information which is written on the overlying log sheet;

wherein portions of the non-adhesive tacky surface grip the underlying sheet thereto to prevent slippage of the underlying sheet while writing thereon; and wherein the underlying sheet is a plurality of spaced apart longitudinal sheets and portions of the non-adhesive and tacky surface grip the overlying log sheet thereto to also prevent slippage of the overlying sheet while writing thereon.

8. The temporary badge security system of claim 6 or 7, wherein the overlying log sheet is carbon-backed.

9. The temporary badge security system of claim 6 or 7, wherein the log sheet comprises a plurality of perforated squares.

10. The temporary badge security system of claim 7, further comprising a mounting means on the writing board for the underlying sheet comprising a plurality of clips, each clip removably mounting a longitudinal sheet to the board.

11. The temporary badge security system of claim 10, wherein the mounting means on the writing board for the overlying sheet comprises a plurality of clips.

12. The temporary badge security system of claim 11, wherein each clip on the writing board comprises a substantially flat spring secured to the board for engaging and holding the sheet lying on the board and means for lifting the spring to remove the sheet.

13. The temporary badge security system of claim 12, wherein the means for lifting the spring comprises a button passing through its lower end projecting from the lower surface of the board and its upper end in contact with the spring, the button slidable within the bore, whereby when the board is forced downward, the button slides upward to raise the spring and release the sheet and when the force is removed from the board the spring engages and holds the sheet.

* * * * *